US006751918B2

(12) United States Patent
Jesko

(10) Patent No.: US 6,751,918 B2
(45) Date of Patent: Jun. 22, 2004

(54) COVER ASSEMBLY FOR STRUCTURAL MEMBERS

(75) Inventor: Thomas A. Jesko, Salem, OH (US)

(73) Assignee: Constuction Research & Technology GmbH, Trostberg (DE)

( * ) Notice: Subject to any disclaimer, the term of this patent is extended or adjusted under 35 U.S.C. 154(b) by 0 days.

(21) Appl. No.: 09/941,804

(22) Filed: Aug. 29, 2001

(65) Prior Publication Data

US 2002/0157338 A1 Oct. 31, 2002

Related U.S. Application Data

(60) Provisional application No. 60/229,111, filed on Aug. 30, 2000.

(51) Int. Cl.[7] ..... E04B 1/62; E04F 15/14; E04F 15/22

(52) U.S. Cl. ..... 52/393; 52/394; 52/395; 52/459; 52/461; 52/403.1; 52/573.1

(58) Field of Search ..... 52/393, 394, 395, 52/396.05, 403.1, 167.1, 167.3, 573.1, 459, 460, 461, 462, 463, 470

(56) References Cited

U.S. PATENT DOCUMENTS 3,435,574 A 4/1969 Hallock
3,659,390 A 5/1972 Balzer et al.
3,696,575 A 10/1972 Armstrong (List continued on next page.)

FOREIGN PATENT DOCUMENTS

JP 6-322848 * 11/1994 ..... E04B/1/68
JP 6-322849 * 11/1994 ..... E04B/1/68

*Primary Examiner*—Carl D. Friedman
*Assistant Examiner*—Chi Q. Nguyen
(74) *Attorney, Agent, or Firm*—Renner, Kenner, Greive, Bobak, Taylor & Weber

(57) ABSTRACT

A cover assembly includes an elongated resilient cover for bridging a gap between horizontal structural members. The upper face surface of the resilient cover has spaced apart ribs extending transverse to the flow of traffic and an opposite surface formed with load bearing edge portions engaged for support with opposite lateral margins to the expansion joint. Between the load bearing edge portions the cover supports at least one rigid metal plate. In one embodiment, a central plate bridges the gap between two structural members and the at least two additional plates serve to urge the opposite lateral edges of the cover into supporting engagement with structural members. The cover has a thickness and sufficient elasticity to elastically deform for establishing supporting contact between the marginal support areas and underlying horizontal structural members. Fasteners are engaged with the cover at spaced apart sites along at least one lateral side portion thereof for elastically anchoring the elongated resilient cover to at least one of the horizontal structural members.

49 Claims, 2 Drawing Sheets

U.S. PATENT DOCUMENTS 3,745,726 A 7/1973 Thom
3,810,707 A 5/1974 Tungseth et al.
3,849,958 A 11/1974 Balzer et al.
3,862,810 A 1/1975 Welch
3,974,609 A 8/1976 Attaway
3,974,614 A 8/1976 Strong
4,022,538 A 5/1977 Watson et al.
4,067,155 A 1/1978 Ruff et al.
4,111,582 A * 9/1978 Tippett ..... 404/47
4,184,298 A 1/1980 Balzer et al.
4,271,650 A 6/1981 Lynn-Jones
4,654,245 A * 3/1987 Balzer et al. ..... 428/52
4,706,318 A 11/1987 Huber et al.
4,815,247 A 3/1989 Nicholas
4,876,759 A 10/1989 Yang
5,020,294 A 6/1991 Duda
5,024,554 A 6/1991 Benneyworth et al.
5,048,249 A 9/1991 Shreiner et al.
5,060,439 A 10/1991 Clements et al.
5,067,297 A 11/1991 Sobol
5,092,094 A 3/1992 Duda et al.
5,211,505 A 5/1993 Ueda
5,263,293 A * 11/1993 Gohlke et al. ..... 52/396.01
5,269,624 A * 12/1993 Kramer ..... 404/64
5,644,879 A * 7/1997 Shreiner et al. ..... 52/393
5,791,111 A 8/1998 Beenders
5,799,456 A 9/1998 Shreiner et al.
5,887,400 A * 3/1999 Bratek et al. ..... 52/396.03
5,888,017 A 3/1999 Corrie
5,911,662 A * 6/1999 Hallsten ..... 52/246
6,112,488 A * 9/2000 Olson et al. ..... 52/393

* cited by examiner

COVER ASSEMBLY FOR STRUCTURAL MEMBERS

CROSS REFERENCE TO RELATED APPLICATIONS

The present application claims the benefit, under 35 U.S.C. §119(e), of the filing date of U.S. Provisional Application Ser. No. 60/229,111, filed Aug. 30, 2000.

TECHNICAL FIELD OF THE INVENTION

The present invention relates to a protective cover for placement over an opening between adjoining horizontal structures. The present invention is more particularly related to cover assemblies that form a bridge over a gap or opening between two horizontal concrete structures. The cover assemblies of the present invention are especially useful to allow a smooth transition of traffic, particularly vehicular traffic, without damage to the structural members and expansion material in a gap between the adjoining horizontal structures.

BACKGROUND OF THE INVENTION

An expansion joint is formed by placing a mass of expansion material in a gap purposely provided between adjoining concrete structures for accommodating dimensional changes to the gap occurring as expansion and contraction due to temperature changes and/or seismic cycling and vibration. The expansion joint may also be damaged by the ingress of surface water but, particularly, by abrasion and compression forces generated by the passage of motorized vehicular traffic.

Expansion joints, particularly in sports stadiums, parking garages and airports are degraded when the expansion material must bear the wear and tear caused by contact with service vehicles, such as fork lifts or other vehicles used to transport supplies and equipment along corridors formed by concrete structures. The expansion material is often ejected from the gap between the concrete structures when the adhesion between the concrete material and the expansion material degrades allowing the ingress of water and development of damaging forces generated at freezing temperatures. A degradation to the expansion material may also occur by the passage of vehicular traffic, particularly when concrete structures form an uneven passageway resulting in impact loading on the structures by the traffic.

Elongated metal plates placed in an end-to-end relationship have been bolted to the concrete structure in an attempt to protect the expansion joint from damage due to pedestrian and vehicular traffic. Often, the metal plates become deformed and do not form a uniform seated engagement with concrete structures particularly where the traffic bearing upper surfaces of the adjoining concrete structures are irregular or undulating, which fails to provide the necessary uniform planar support for the metal plates. The metal plates are bent and distorted due to impact loading of traffic and acquire a state of looseness about their mounting bolts which degrades further when the mounting bolts eventually shear. Even before the metal plates become disjointed from the mounting bolts, the metal plates generate an annoying noise with each deflection against the adjoining concrete structures.

Additionally, it is widely known that the surfaces of concrete structural members are not always entirely uniform, and are often not produced with square or smooth surfaces. These concrete structural members are usually rough, often have substantially irregular or undulating gaps, or are missing entire chunks of concrete. Furthermore, there is often a vertical "offset" between two structural members, due to the settlement of concrete.

Therefore, a need exists in the art for an improved cover assembly to bridge gaps or openings between structural members to provide a smooth transition over the gap and to substantially reduce the trip hazard for pedestrians. There is also a need to provide a cover assembly to protect expansion joint material in a gap between structural members, such as concrete structures.

SUMMARY OF THE INVENTION

The present invention provides a cover apparatus for a gap between structural members having the resiliency to conform to the configuration of the support sites provided by structural members.

The present invention also provides a resilient cover apparatus combined with members for adding mass to the cover to stabilize the cover particularly during the passage of traffic.

The present invention further provides a resilient cover with parallel spaced apart elongated plate members supported by a face surface of the cover directed toward a gap or opening between structural members to stabilize opposite lateral edges of the resilient cover undergoing elastic deformation by traffic.

These and other aspects of the present invention are accomplished by the cover assembly and method of installation which is hereafter described and claimed. The aspects and advantages of the invention may be realized and attained by means of the embodiments and combinations particularly pointed out in the attached claims.

Accordingly, the present invention provides a cover assembly for a gap between two horizontal structural members comprising: an elongated resilient cover having a load bearing surface opposite a support surface including marginal support areas along opposite lateral edges thereof, said cover having a thickness and sufficient elasticity to elastically deform for establishing supporting contact between said marginal support areas and underlying horizontal structural members adjacent to a gap between said structural members; a rigid plate member, secured along said support surface of said elongated resilient cover by an attachment means, for bridging a gap between said horizontal structural members; and a plurality of fasteners engaged with said cover at spaced apart sites along at least one lateral side portion of said cover for elastically anchoring said elongated resilient cover to at least one of the horizontal structural members.

In another embodiment, the present invention provides a cover assembly that further comprises at least two rigid plate members secured along said support surface of said elongated resilient cover by an attachment means to extend along opposite lateral sides of said rigid plate member.

The present invention also provides a cover assembly for a gap between horizontal structural members comprising: an elongated resilient cover having a predetermined width sufficient to overlie portions of horizontal structural members outwardly of marginal edges to a gap between the horizontal structural members; a rigid plate member, secured to said elongated resilient cover by an attachment means, for stabilizing said cover while traffic traverses said cover, said rigid plate member defining an elongated bridging member having a width sufficient to span the width of a gap between said horizontal structural members while secured thereby;

and a plurality of fasteners to anchor said resilient cover along at least one marginal edge of said resilient cover to at least one of said horizontal structural members.

In another embodiment, the present invention provides a cover assembly that further comprises at least two rigid plate members secured to said resilient cover by an attachment means and being restrained by said resilient cover to extend in a side-by-side relation to said elongated bridging member.

The present invention also provides an expansion joint for a building structure comprising: two spaced apart structural members defining a gap therebetween; and a cover assembly comprising an elongated resilient cover having a load bearing surface opposite a support surface including marginal support areas along opposite lateral edges thereof, said cover having a thickness and sufficient elasticity to elastically deform for establishing supporting contact between said marginal support areas and underlying horizontal structural members adjacent an expansion joint; a rigid plate member, secured along said support surface of said elongated resilient cover by an attachment means, for bridging a joint formed in a gap between said horizontal structural members; and a plurality of fasteners engaged with said cover at spaced apart sites along at least one lateral side portion of said resilient cover to elastically anchor said elongated resilient cover to at least one of the horizontal structural members.

In another embodiment, the present invention provides a cover for an expansion joint, wherein said cover further comprises at least two plate members restrained along said support surface by said elongated resilient cover to extend along opposite lateral sides of said rigid plate member for allowing elastic deformation of said cover and apply a biasing force in a direction to urge opposite lateral sides of said cover toward the horizontal structural members while resiliently deformed by traffic traversing said load bearing surface.

The present invention also provides a method for the installation of a cover assembly across a gap between two structural member comprising: providing a cover assembly comprising an elongated resilient cover having a load bearing surface opposite a support surface including marginal support areas along opposite lateral edges thereof, said cover having a thickness and sufficient elasticity to elastically deform for establishing supporting contact between said marginal support areas and underlying horizontal structural members; a rigid plate member, secured along said support surface of said elongated resilient cover by an attachment means, for bridging a joint formed in a gap between said horizontal structural members; and a plurality of fasteners engaged with said cover at spaced apart sites along at least one lateral side portion of said resilient cover to elastically anchor said elongated resilient cover to at least one of the horizontal structural members; and placing said cover assembly across said gap.

In another embodiment, the method of installation utilizes a cover assembly that further comprises at least two plate members restrained along said support surface by said elongated resilient cover to extend along opposite lateral sides of said rigid plate member for allowing elastic deformation of said cover and apply a biasing force in a direction to urge opposite lateral sides of said cover toward the horizontal structural members while resiliently deformed by traffic traversing said traffic bearing surface.

BRIEF DESCRIPTION OF THE DRAWINGS

The present invention will be more fully understood when the following description is read in light of the accompanying drawings in which.

DETAILED DESCRIPTION OF THE DESCRIPTION

The present invention provides a cover assembly for a gap or opening between building structures. In general, the cover assembly comprises an elongated resilient cover having a traffic bearing surface opposite a support surface including marginal support areas along opposite lateral edges thereof, at least one rigid plate member restrained along the support surface of the elongated resilient cover for bridging a gap or opening between two horizontal structural members, and a plurality of fasteners that are engaged with the resilient cover at space apart sites along at least one lateral side portion of the resilient cover.

The resilient cover plate has a thickness and sufficient elasticity to elastically deform to establish supporting contact between the marginal support areas of the cover assembly and the underlying horizontal structural members to provide a smooth transition over the gap or opening for pedestrian or vehicular traffic. The fasteners are provided to elastically anchor the elongated resilient cover to at least one of the horizontal structural members.

In another embodiment, the present invention provides a cover assembly that comprises an elongated resilient cover having a traffic bearing surface opposite a support surface including marginal support areas along opposite lateral edges thereof, a first rigid plate member restrained along the support surface of the elongated resilient cover for bridging a gap or opening between two horizontal structural members, at least two additional rigid plate members that are restrained along the support surface by the elongated resilient cover to extend along opposite lateral sides of the first rigid plate members, and a plurality of fasteners that are engaged with the resilient cover at space apart sites along a lateral side portion of the cover. The additional rigid plate members are placed on opposite lateral sides of the first rigid plate to allow elastic deformation of the resilient cover and to apply a biasing force in a direction to urge opposite lateral sides of the cover toward the horizontal structural members when the cover is resiliently deformed by pedestrian or vehicular traffic traversing the traffic bearing surface of the cover.

Figure 1:
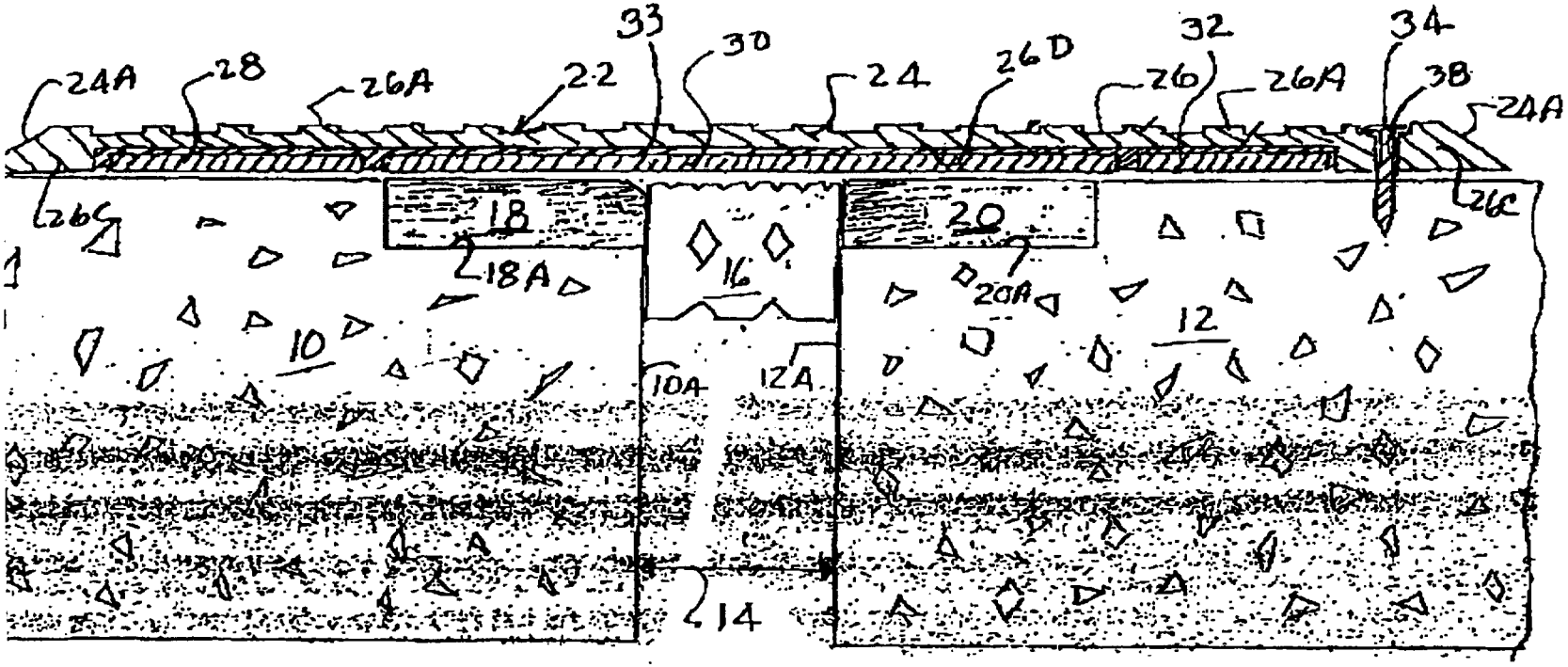
FIG. 1 is an elevational view in section illustrating a cover apparatus of the present invention.
Figure 2:
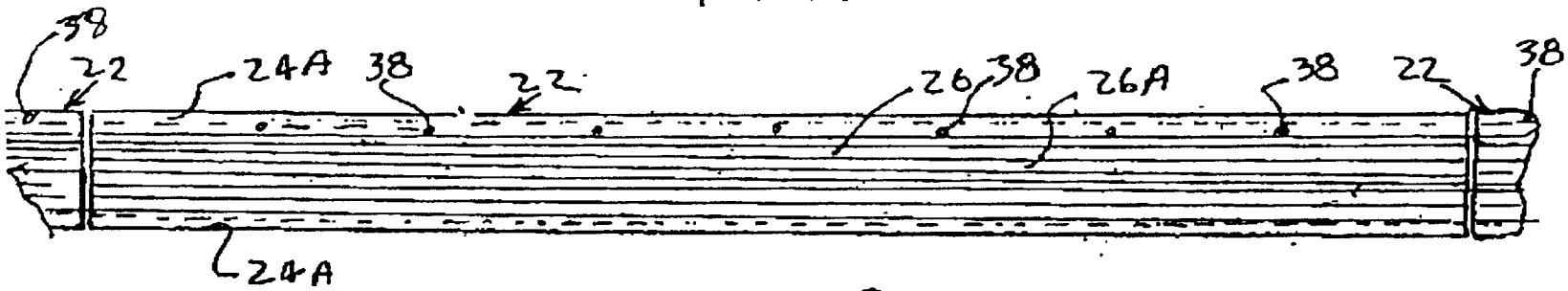
FIG. 2 is a plan view of the cover apparatus shown in FIG. 1.

As illustrated in FIGS. 1 and 2, structural members 10 and 12 are positioned to form a gap 14 between terminal end surfaces 10A and 12A of the structural members 10 and 12, respectively. The structural members may take the form of precast slabs used to form passageways for both vehicle and pedestrian traffic. The structural members are supported by underlying superstructure, not shown. In sports stadiums, the construction of walkways is designed to accommodate mechanical vibration often generated by enthusiastic fans as well as dimensional changes responsive to seismic cycling and temperature variations. The gap 14 contains a mass of joint material 16 of sufficient volume to fully occupy the width of the gap 14 along a predetermined height commencing at an elevation generally in a horizontal plane containing the face surfaces of the structural members 10 and 12. The joint material in the embodiment illustrated in FIG. 1 is situated to occupy the volume between inserts 18 and 20 forming marginal edge cavities 18A and 20A in the structural members 10 and 12, respectively. The cavities are commonly known as a block out condition and may not be equipped with the inserts 18 and 20. When the inserts are provided, they are made of concrete, elastomer compounds or rubber materials and are held in the cavities 18A and 20A by a suitable bolting system or adhesives.

A cover apparatus 22 embodying a construction of parts, according to the present invention, includes an elongated resilient cover 24 placed to overlie the joint material 16 and to extend along opposite lateral sides of the gap 14 between the structural members. The cover 24 has a predetermined extended length suitably selected to allow convenient handling and installation and, as shown in FIG. 2, three or more covers 24 are preferably arranged in an end-to-end relationship to protect joint material along the entire length of an extended gap.

The cover 24 has the form of a flexible, elastic strip like member having an upwardly directed load bearing face surface 26 with spaced apart upstanding ribs 26A arranged to extend transversely to the direction of traffic for improved traction. The opposite lateral terminal edges of the cover have tapered face surfaces 24A for providing inclined planes for smoothing the transition from the traffic bearing face surface of one of the structural members 10 and 12 to the cover 22 and then from the cover 22 to the traffic bearing face surface of adjoining one of the structural members 10 and 12.

The surface of the cover 22 directed toward the joint material 16 and structural members 10 and 12 is made up of thickened peripheral edges 26C forming a surrounding border of a recessed face surface 26D. In the embodiment of the invention shown in FIGS. 1 and 2, three spaced apart, substantially parallel, plate members 28, 30 and 32 are attached to the recessed face surface 26D by an attachment means. In a preferred embodiment, the substantially parallel, plate members 28, 30 and 32 are adhered by a mass of adhesive 33 to the recessed face surface 26D of the cover for support. The plate member 30 is adhered to the cover 22 at a central position to overlie the gap 14 and protect the expansion material 16 by forming a bridge to transfer the weight of traffic to the structural members 10 and 12.

While the rigid plate members 28, 30 and 32 are preferably attached to the recesses face surface 26D of the cover 22 by an adhesive, other suitable means for attaching the rigid plates to the cover may be utilized. For example, the rigid plate members can be mechanically connected to the cover 22 with mechanical fasteners Suitable mechanical fasteners include, but should not be limited to nails, screws, tacks and rivets. It is important to note that the mechanical fasteners can be made from metal or a polymeric material.

The rigid plate members may be rolled steel, stainless steel, galvanized steel and aluminum plates. The plate members 28 and 32 are preferably galvanized steel plates at least three or four inches wide and having a thickness to impart mass to the cover for assuring a seated engagement with opposite lateral sides of the structural members 10 and 12.

Anchoring fasteners 34 extend through suitable openings arranged at spaced apart locations along at least one edge of the resilient cover into the underlying structural member 12. The anchoring fasteners 34 may include screws, nails, rivets, and the like.

The cover 24 is constructed from elastic material particularly, for example, extruded rubber, such that spaced apart openings 38 along the edge of the cover are uninhibited from elastic deformation to prevent dislodgment and breakage of the fasteners. The elastic construction of the cover is also chosen to insure that the cover will elastically conform into supporting contact with the underlying support structures, which can have irregular configurations without the loss of supporting contact. This insures stability to the cover which is enhanced by the mass represented by the weight of the plates 28, 30 and 32.

Preferably, the cover is constructed of elastomeric material containing fillers and a precisely chosen amount of a plasticizer to yield a rubber material having a durometer reading of about 80. The term "elastomeric" refers for a material that possess rubber-like properties, for example, an elastomeric material will substantially recover its original dimensions after compression and/or elongation. Any elastomeric material may be used to prepare the resilient cover 24 of the present invention, so long as the cover 24 can be prepared to a thickness and sufficient elasticity to elastically deform to establish supporting contact between the marginal support areas of the cover assembly and the underlying horizontal structural members to provide a smooth transition over the gap or opening for pedestrian or vehicular traffic.

Suitable elastomeric materials used to prepare the resilient cover 24 include, but should not be limited to, styrene-butadiene rubber (SBR), butadiene rubber (BR), butyl rubber, ethylene-propylene rubber (EPM), ethylene-propylene-diene rubber (EPDM), polyisoprene rubber, polychloroprene rubber, various ethylene-alkene copolymer rubbers, silicon rubber, nitrile rubber, and blends thereof.

In one preferred embodiment of the present invention, an ethylene-propylene-diene rubber (EPDM) is utilized to prepare the cover 24 of the present invention. A particularly suitable EPDM rubber composition that is useful to prepare the cover 24 is commercially available from Advanced Elastomer Systems, L.P. (Akron, Ohio) under the trade name Santoprene™.

Figure 3:
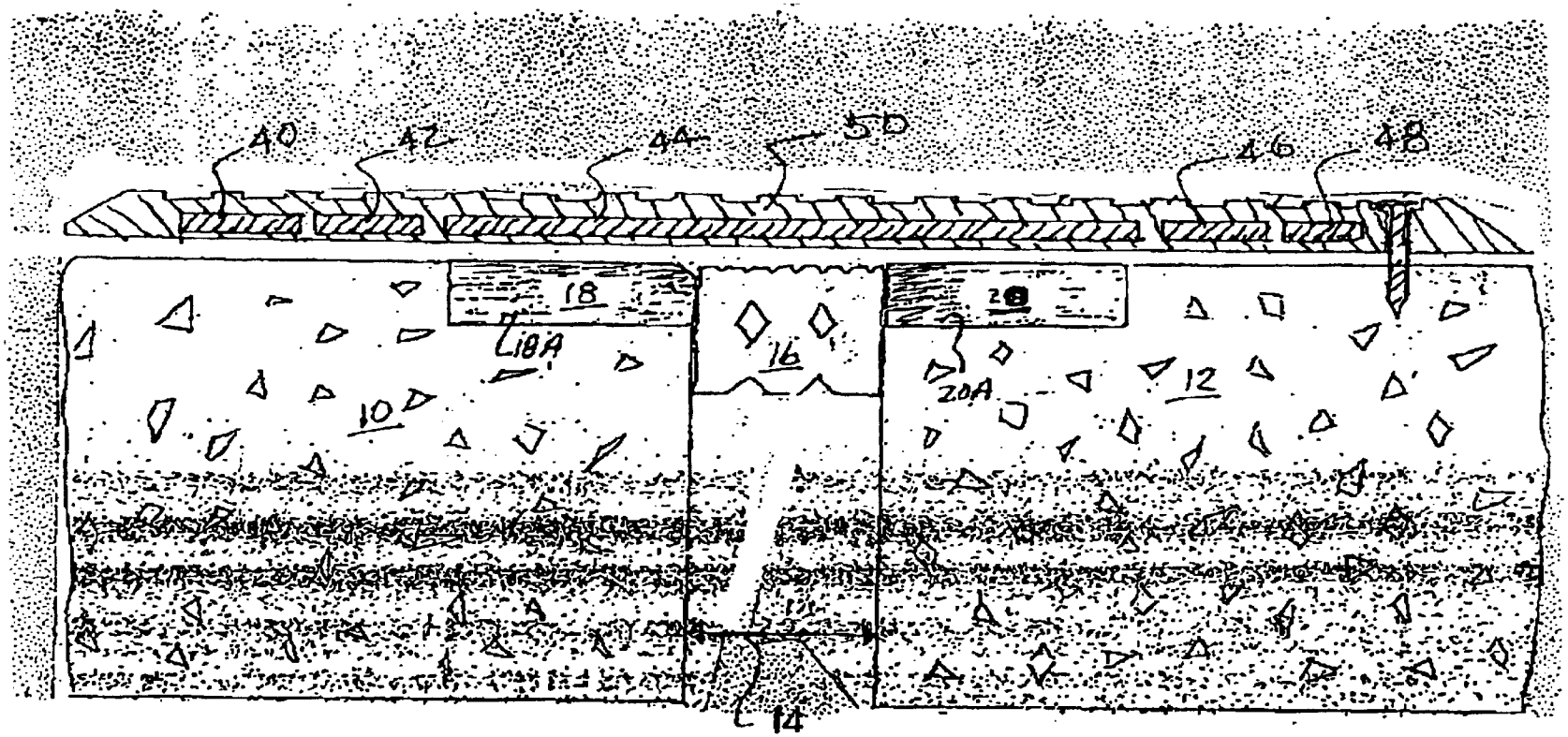
FIG. 3 is an elevational view in section similar to FIG. 1 and illustrating another embodiment of the present invention.

In the another embodiment of the present invention, illustrated in FIG. 3, there is shown five plate members 40, 42, 44, 46 and 48 embedded in the elastic material of cover 50. The embedded relation of the rigid plate members in the cover 24 is formed by introducing the plate members as inserts during the forming process for the cover whereby the plate members are encapsulated by the elastomeric material of the cover. The multiplicity of plate members increases the adaptability of the cover apparatus to greater variations to the contour of the underlying support surfaces of the structural members 10 and 12.

The present invention also provides a method of installation of a cover assembly to bridge a gap or opening between two spaced structural members, such as concrete slabs. In a preferred embodiment, the present invention provides a method for the installation of a cover assembly to bridge a gap formed by an expansion joint between two structural members.

It should be noted that the cover assembly of the present invention is not limited to placement across a gap or opening in a structural expansion joint. To the contrary, the cover assembly of the present invention can be used to bridge an opening or gap between any two structural members to create a smooth traffic transition between the two structural members. The cover assembly is particularly useful to bridge an opening or gap between vertically offset structural members. For example, the cover assembly of the present invention can be used to bridge structural members, such as concrete slabs, which are designed to be vertically offset or that may become vertically offset or displaced due to differential concrete settlement.

In situations where there is a more severe vertical offset or slope between two opposing concrete members or slabs, the rigid plate member that bridges the gap between the opposing structural members can include a permanent bend. Providing a bend in the rigid plate member provides a more smooth transition between the opposing structural members having a severe vertical offset for vehicular and pedestrian traffic.

As described hereinabove, it is widely known that surface of concrete structural members are not entirely uniform, and are often not produced with square or smooth surfaces. These concrete structural members are usually rough, often have substantially irregular or undulating gaps, or are missing entire chunks of concrete. Metal plates have been traditionally used in cover plate assemblies, but cannot conform to the contours of the concrete structural members and, therefore, a potentially dangerous hazard exists for pedestrian and vehicular traffic. The cover assembly of the present invention is prepared from an elastomeric resilient material than can be elastically deformed, in response to a load applied to it, to conform to the irregular or undulating contours present often found in structural members. The present invention, therefore, provides a means a smooth the transition across the irregular surfaces of the structural members and to substantially eliminate the hazards associated with the irregular surface of structural members, such as concrete slabs.

In addition, the cover assembly of the present invention can be used as a temporary expansion joint cover during construction of building structures to allow for a smooth passage of construction workers and equipment across the expansion joints in a building structure.

While the present invention has been described in connection with the preferred embodiments, as shown in the various figures, it is to be understood that other similar embodiments may be used or modifications and additions may be made to the described embodiment for performing the same function of the present invention without deviating therefrom. Additionally, the specific materials used to prepare the elastomeric resilient cover and the rigid plates, the attachment means to used to attach the rigid plates to the resilient cover, and the choice of fastening means can be selected without departing from the spirit and scope of the invention. Therefore, the present invention should not be limited to any single embodiment, but rather construed in breadth and scope in accordance with the recitation of the appended claims.

I claim:

1. A cover assembly for a gap between two structural members comprising:

an elongated resilient cover having a load bearing surface opposite a support surface including marginal support areas along opposite lateral edges thereof, said opposite lateral edges having tapered face surfaces for providing inclined planes, said cover having a thickness and sufficient elasticity to elastically deform for establishing supporting contact between said marginal support areas and underlying horizontal structural members adjacent to a gap between said horizontal structural members;

a rigid plate member secured along said support surface of said elongated resilient cover by an attachment means for bridging a gap between said horizontal structural members; and a plurality of fasteners engaged with said cover at spaced apart sites along at least one lateral side portion of said cover for elastically anchoring said elongated resilient cover to at least one of the horizontal structural members.

2. The cover assembly of claim 1, further comprising at least two rigid plate members secured along said support surface of said elongated resilient cover by an attachment means to extend along opposite lateral sides of said rigid plate member.

3. The cover assembly of claim 2, wherein said at least two rigid plate members are provided to allow elastic deformation of said cover and apply a biasing force in a direction to urge opposite lateral sides of said cover toward the horizontal structural members while resiliently deformed by traffic traversing said traffic bearing surface.

4. The cover assembly of claim 1, wherein said attachment means is selected from the group consisting of adhesives and mechanical fasteners.

5. The cover assembly of claim 4, wherein said attachment means is an adhesive.

6. The cover assembly of claim 5, wherein the attachment means is a mass of adhesive for securing said rigid plate member to said elongated resilient cover.

7. The cover assembly of claim 4, wherein said mechanical fasteners are selected from the group consisting of nails, screws, rivets and tacks.

8. The cover assembly of claim 2, wherein said attachment means is selected from the group consisting of adhesives and mechanical fasteners.

9. The cover assembly of claim 8, wherein said attachment means is an adhesive.

10. The cover assembly of claim 9, wherein the attachment means is a mass of adhesive for securing said at least two rigid plate members to said elongated resilient cover.

11. The cover assembly of claim 8, wherein said mechanical fasteners are selected from the group consisting of nails, screws, rivets and tacks.

12. The cover assembly of claim 1, wherein said elongated resilient cover includes thickened peripheral edges defining a border to a recessed face surface, said face surface supporting said rigid plate member.

13. The cover assembly of claim 2, wherein said elongated resilient cover includes thickened peripheral edges defining a border to a recessed face surface, said face surface supporting said rigid plate member, and said at least two rigid plate members.

14. The cover assembly of claim 12, wherein said thickened peripheral edges include tapered face surfaces for providing incline plates to bear traffic traversing the cover.

15. The cover assembly of claim 13, wherein said thickened peripheral edges include tapered face surfaces for providing incline plates to bear traffic traversing the cover.

16. The cover assembly of claim 1, wherein said load bearing surface includes spaced apart upstanding ribs arranged to extend transversely to the direction of traffic traversing the cover.

17. The cover assembly of claim 2, wherein said load bearing surface includes spaced apart upstanding ribs arranged to extend transversely to the direction of traffic traversing the cover.

18. The cover assembly of claim 1, wherein said elongated resilient cover encapsulates said rigid plate member.

19. The cover assembly of claim 2, wherein said elongated resilient cover encapsulates said at least two rigid plate members.

20. A cover assembly for a gap between horizontal structural members comprising:

an elongated resilient cover having a load bearing surface opposite a support surface including marginal support areas along opposite lateral edges thereof, said opposite lateral edges having tapered face surfaces for providing inclined planes, and a predetermined width sufficient to overlie portions of horizontal structural members outwardly of marginal edges to a gap between the horizontal structural members;

a rigid plate member secured to said elongated resilient cover by an attachment means for stabilizing said cover while traffic traverses said cover, said rigid plate member defining an elongated bridging member having a width sufficient to span the width of a gap between horizontal structural members while secured thereby;

a plurality of fasteners to anchor said resilient cover along at least one marginal edge of said resilient cover to at least one of said horizontal structural members.

21. The cover assembly of claim 20, wherein said assembly further comprises at least two rigid plate members secured to said resilient cover by an attachment means and being restrained by said resilient cover to extend in a side-by-side relation to said elongated bridging member.

22. The cover assembly of claim 20, wherein the attachment means is selected from the group consisting of adhesives and mechanical fasteners.

23. The cover assembly of claim 22, wherein the attachment means is an adhesive.

24. The cover assembly of claim 23, wherein the attachment means is a mass of adhesive for securing said rigid plate member to said elongated resilient cover.

25. The cover assembly of claim 22, wherein the mechanical fasteners are selected from the group consisting of nails, screws, rivets and tacks.

26. The cover assembly of claim 20, wherein said elongated resilient cover includes thickened peripheral edges defining a border to a recessed face surface, said face surface supporting said rigid plate member.

27. The cover assembly of claim 26, wherein said thickened peripheral edges include tapered face surfaces for providing incline plates to bear traffic traversing said cover.

28. The cover assembly of claim 20, wherein said traffic bearing surface includes spaced apart upstanding ribs arranged to extend transversely to the direction of traffic traversing the cover.

29. The cover assembly of claim 20, wherein said elongated resilient cover encapsulates said plurality of rigid plate members for support thereby.

30. The cover assembly of claim 21, wherein the attachment means is selected from the group consisting of adhesives and mechanical fasteners.

31. The cover assembly of claim 30, wherein the attachment means is an adhesive.

32. The cover assembly of claim 31, wherein the attachment means is a mass of adhesive for securing said rigid plate member and said at least two rigid plate members to said elongated resilient cover.

33. The cover assembly of claim 30, wherein the mechanical fasteners are selected from the group consisting of nails, screws, rivets and tacks.

34. The cover assembly of claim 21, wherein said elongated resilient cover includes thickened peripheral edges defining a border to a recessed face surface, said face surface supporting said rigid plate member and said at least two rigid plate members.

35. The cover assembly of claim 34, wherein said thickened peripheral edges include tapered face surfaces for providing incline plates to bear traffic traversing said cover.

36. The cover assembly of claim 21, wherein said traffic bearing surface includes spaced apart upstanding ribs arranged to extend transversely to the direction of traffic traversing the cover.

37. The cover assembly of claim 21, wherein said elongated resilient cover encapsulates said rigid plate member and said at least two rigid plate members for support thereby.

38. An expansion joint for a building structure comprising:

two spaced structural members defining a gap therebetween; and a cover assembly comprising an elongated resilient cover having a load bearing surface opposite a support surface including marginal support areas along opposite lateral edges thereof, said opposite lateral edges having tapered face surfaces for providing inclined planes, said cover having a thickness and sufficient elasticity to elastically deform for establishing supporting contact between said marginal support areas and underlying horizontal structural members adjacent an expansion joint;

a rigid plate member secured along said support surface of said elongated resilient cover by an attachment means for bridging a joint formed in a gap between said horizontal structural members; and a plurality of fasteners engaged with said cover at spaced apart sites along at least one lateral side portion of said resilient cover to elastically anchor said elongated resilient cover to at least one of the horizontal structural members.

39. The expansion joint of claim 38, further comprising at least two plate members restrained along said support surface by said elongated resilient cover to extend along opposite lateral sides of said rigid plate member for allowing elastic deformation of said cover and apply a biasing force in a direction to urge opposite lateral sides of said cover toward the horizontal structural members while resiliently deformed by traffic traversing said load bearing surface.

40. The cover assembly of claim 38, wherein the attachment means is selected from the group consisting of adhesives and mechanical fasteners.

41. The cover assembly of claim 40, wherein the attachment means is an adhesive.

42. The cover assembly of claim 41, wherein the attachment means is a mass of adhesive for securing said rigid plate member and said at least two rigid plate members to said elongated resilient cover.

43. The cover assembly of claim 40, wherein the mechanical fasteners are selected from the group consisting of nails, screws, rivets and tacks.

44. The cover assembly of claim 39, wherein the attachment means is selected from the group consisting of adhesives and mechanical fasteners.

45. The cover assembly of claim 44, wherein the attachment means is an adhesive.

46. The cover assembly of claim 45, wherein the attachment means is a mass of adhesive for securing said rigid plate member and said at least two rigid plate members to said elongated resilient cover.

47. The cover assembly of claim 44, wherein the mechanical fasteners are selected from the group consisting of nails, screws, rivets and tacks.

48. A method for the installation of a cover assembly across a gap between two structural member comprising:

providing a cover assembly comprising an elongated resilient cover having a load bearing surface opposite a support surface including marginal support areas along opposite lateral edges thereof, said opposite lateral edges having tapered face surfaces for providing inclined planes, said cover having a thickness and sufficient elasticity to elastically deform for establishing supporting contact between said marginal support areas and underlying horizontal structural members;

a rigid plate member secured along said support surface of said elongated resilient cover by an attachment means for bridging a joint formed in a gap between said horizontal structural members; and a plurality of fasteners engaged with said cover at spaced apart sites along at least one lateral side portion of said resilient cover to elastically anchor said elongated resilient cover to at least one of the horizontal structural members; and placing said cover assembly across said gap.

49. The method of claim 48, wherein the cover assembly further comprises at least two plate members restrained along said support surface by said elongated resilient cover to extend along opposite lateral sides of said rigid plate member for allowing elastic deformation of said cover and apply a biasing force in a direction to urge opposite lateral sides of said cover toward the horizontal structural members while resiliently deformed by traffic traversing said traffic bearing surface.

* * * * *